US006584615B1

(12) United States Patent
Wilder et al.

(10) Patent No.: US 6,584,615 B1
(45) Date of Patent: Jul. 1, 2003

(54) ASYMMETRICAL HOCKEY GLOVE SYSTEM WITH ARTICULATED LOCKING THUMB

(75) Inventors: Thomas V. Wilder, Laguna Niguel, CA (US); Craig Johnson, Long Beach, CA (US); Jocelyn Poulin, Laguna Niguel, CA (US)

(73) Assignee: Mission Hockey Company, Santa Ana, CA (US)

( * ) Notice: Subject to any disclaimer, the term of this patent is extended or adjusted under 35 U.S.C. 154(b) by 0 days.

(21) Appl. No.: 09/420,738

(22) Filed: Oct. 20, 1999

Related U.S. Application Data

(60) Provisional application No. 60/107,357, filed on Nov. 6, 1998.

(51) Int. Cl.[7] ..... A41D 13/08; A41D 19/00

(52) U.S. Cl. ..... 2/16; 2/161.1; 2/161.3; 2/161.4; 2/159

(58) Field of Search ..... 2/161.1, 161.3, 2/159, 161.4, 161.6, 161.8, 167, 169, 16

(56) References Cited

U.S. PATENT DOCUMENTS

| | | | | |
|---|---|---|---|---|
| 2,293,347 A | | 8/1942 | Lindfeld | |
| 2,708,753 A | | 5/1955 | Kennedy | |
| 2,831,196 A | | 4/1958 | Scheiber | |
| 3,387,306 A | | 6/1968 | Korey | |
| 3,626,515 A | | 12/1971 | Murray | |
| 4,095,292 A | * | 6/1978 | Klein | 2/161.2 |
| 4,484,359 A | | 11/1984 | Tirinen | 2/161.1 |
| 4,497,073 A | | 2/1985 | Deutsch | 2/161.1 |
| 4,677,698 A | | 7/1987 | Angas | |
| 4,700,405 A | * | 10/1987 | Sternberg | 2/161.1 |
| 4,742,579 A | * | 5/1988 | Dunford | 2/160 |
| 4,815,147 A | | 3/1989 | Gazzano et al. | 2/161.1 |
| 5,237,703 A | | 8/1993 | Brine et al. | |
| 5,329,639 A | | 7/1994 | Aoki | |
| 5,488,739 A | | 2/1996 | Cardinal | 2/161.1 |
| 5,511,243 A | | 4/1996 | Hall et al. | 2/161.1 |
| D376,676 S | | 12/1996 | Chen | D29/116 |
| 5,717,994 A | * | 2/1998 | Goldsmith | 2/19 |
| 5,781,929 A | | 7/1998 | Shikatani | |
| 5,787,506 A | | 8/1998 | Wilder et al. | |
| D403,127 S | | 12/1998 | Castonguay et al. | D29/117 |
| 5,884,329 A | | 3/1999 | Goldsmith et al. | |
| 5,983,396 A | | 11/1999 | Morrow et al. | 2/161.1 |
| 6,233,744 B1 | | 5/2001 | McDuff | |

FOREIGN PATENT DOCUMENTS

| | | |
|---|---|---|
| DE | 2842720 | 4/1980 |
| DE | 2843448 | 4/1980 |
| DE | 3135756 | 4/1980 |

OTHER PUBLICATIONS

BiltRite Advertisement, The Works Series Glove, Jun. 1998.

* cited by examiner

*Primary Examiner*—John J. Calvert
*Assistant Examiner*—Robert H. Muromoto, Jr.
(74) *Attorney, Agent, or Firm*—Knobbe, Martens, Olson & Bear, LLP.

(57) ABSTRACT

A hockey glove system is disclosed having asymmetrical upper and lower hockey gloves, each being optimized for its particular role and position. The lower glove has only three finger gussets and is adapted for the last two fingers of the wearer's hand to be together in one gusset in order to maximize power and control. The upper glove has four finger gussets and is adapted to maximize the player's grasp on the hockey stick and enable a stable pivot point. Each glove has padding adapted and arranged to protect the portions of the wearer's hands most vulnerable in their respective positions. Each glove further has an articulated thumb skeleton disposed in the thumb member. The thumb skeleton comprises a plurality of sections pivotably joined together to enable the thumb to articulate between open and closed positions. A locking mechanism is provided for preventing the thumb skeleton sections from bending backwards, thereby preventing hyperextension of the wearer's thumb.

33 Claims, 6 Drawing Sheets

FIG. 1
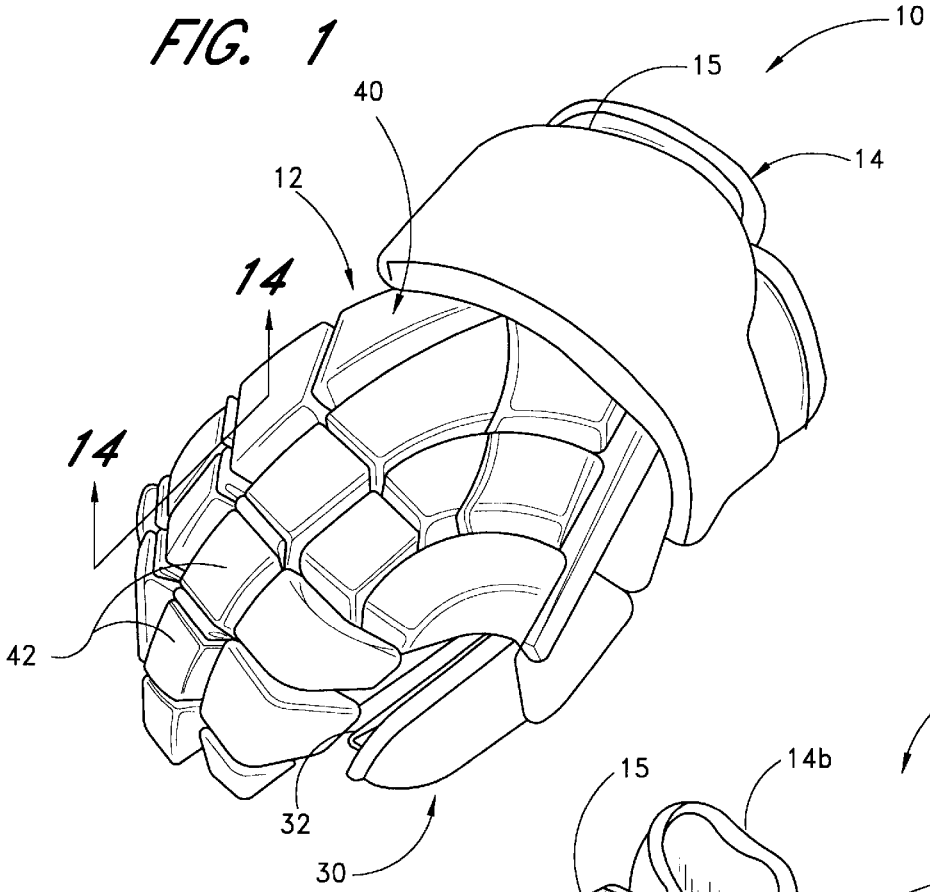
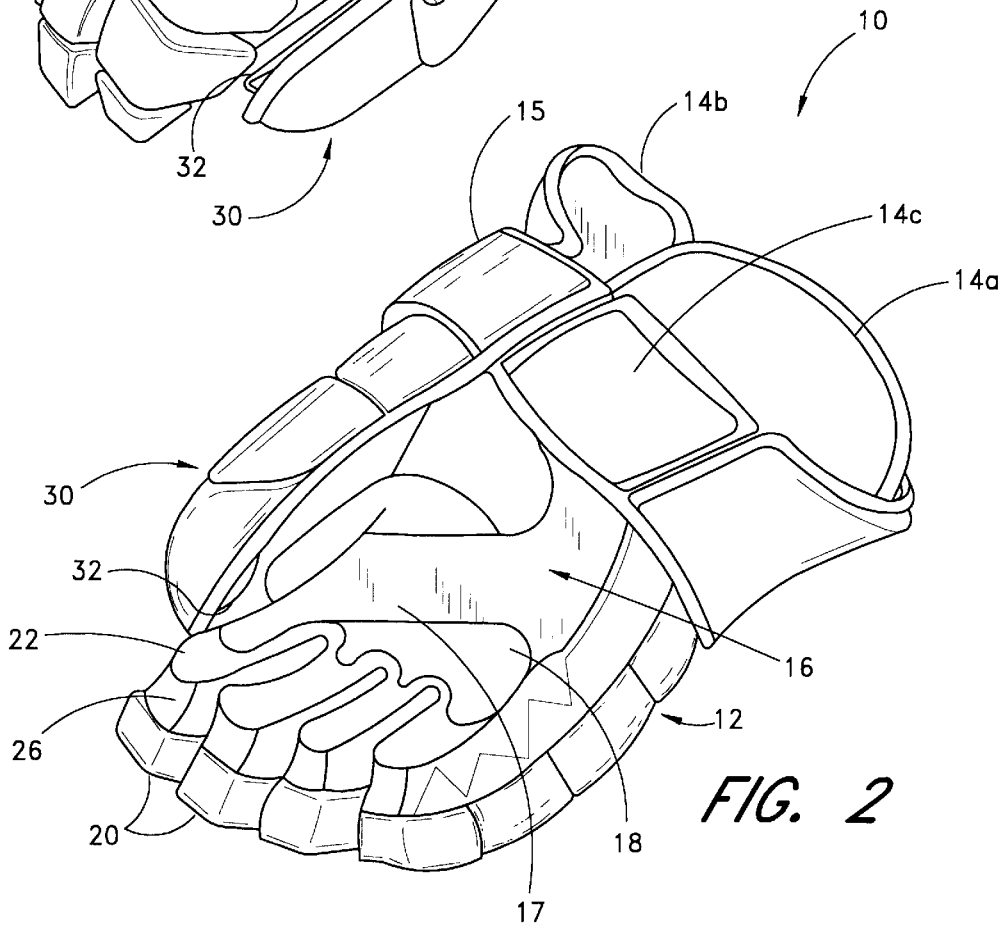
FIG. 2

ASYMMETRICAL HOCKEY GLOVE SYSTEM WITH ARTICULATED LOCKING THUMB

RELATED APPLICATIONS

This application claims priority under 35 U.S.C. 119(e) from Provisional Application No. 60/107,357, filed on Nov. 6, 1998.

FIELD OF THE INVENTION

This invention relates generally to the field of protective outer gear, and more particularly to protective gloves for use in playing hockey.

BACKGROUND OF THE INVENTION

Hockey is a fast-moving, competitive game involving extensive contact between players and implements. Thus, hockey players wear padding and protective gloves while playing. Because of the thick padding required to absorb repeated impact with sticks, players and walls, hockey gloves tend to be bulky, and cumbersome and can restrict desired finger and hand movement.

For example, a hockey player's thumb tends to receive much physical contact from opposing players, sticks, walls, etc. Accordingly, the thumb of a hockey glove is heavily padded. Also, during play, impact may tend to hyperextend the player's thumb. Accordingly, hockey gloves usually have a stiffened member provided in the thumb padding in order to prevent such hyperextension. However, the stiffened member usually substantially constricts normal articulated movement of the player's thumb. Thus, the thumb tends to have awkward and uncomfortable movement during play because of the glove. This may affect a player's performance.

To facilitate thumb movement, some gloves have a loop formed on the palm side to create a thumb pocket for alternative placement of the wearer's thumb in the glove. This thumb pocket allows the thumb to move with more freedom, being less connected to the padding and the stiffened member. However, such an arrangement provides less complete padding protection and exposes the thumb to dangerous impact from sticks, etc. Also, since the thumb pocket is still joined to the thumb padding, the stiffened member still restricts movement of the thumb even when the wearer's thumb is in the pocket.

Hockey players generally hold the hockey stick with an upper hand near the butt of the stick and a lower hand gripping the shaft nearer the blade. A typical right-handed hockey player will use his left hand to grasp the stick near the butt of the shaft. This left hand is the main hand for grasping the stick and acts to provide stability to the player's grip. Also, this upper hand acts as a pivot point when the player shoots or passes the puck. A right-handed hockey player generally positions his right hand on the handle of the shaft but closer to the blade. This lower hand acts as the main power generator and controller of the hockey stick. The player uses this lower hand to generate power during shots and slashing movements, as well as during passing, receiving, and advancement of the puck. This lower hand is also the main controller of the player's grip on the stick.

Because of their differing positions and purposes, the upper and lower hands tend to grip the hockey stick from different perspectives. For instance, during play, the lower hand is wrapped around the stick with the palm facing generally upward and slightly to the side, while the upper palm generally faces downward. Because of these opposing orientations, the upper and lower hands tend to be impacted in different places.

Although each hand of a hockey player has a different function or role during a hockey game and different protection needs, traditional hockey glove pairs have included symmetrical right and left gloves. These glove pairs ignore the differences between the grasping/pivot role of the upper glove and the power/control role of the lower glove.

SUMMARY OF THE INVENTION

Accordingly, there is a need in the art for a system of hockey gloves that facilitates articulated movement of the thumb and includes upper and lower gloves that are specially adapted for their particular roles and positions on the hockey stick.

An object of the current invention, therefore, is to provide a hockey glove having an articulated thumb that is less restrictive to natural movement of the wearer's thumb, but still protects the wearer's thumb from impact and hyperextension. Another object of the current invention is to provide a hockey glove system wherein the upper and lower gloves are each configured to maximize their suitability for their respective functions.

In accordance with one aspect of the present invention, a hockey glove thumb member is provided having articulated stiffening sections that roughly correspond to the sections of a players thumb. These sections are stiffened to absorb and protect the thumb from impacts and are pivotably connected so as to allow them to rotate relative to each other and articulate in a manner similar to a human thumb. However, adjoining segments have stops or locks disposed therebetween to prevent the sections from rotating to such a degree that would cause hyperextension of the wearer's thumb. At each junction, a section that is closer to the tip of the thumb overlaps an adjoining base section. A notch is formed in the base section and an extension extends from this base section beyond the notch. The tip segment overlaps this extension of the base segment, wherein the pivot point is disposed. Accordingly, the tip is rotatable relative to the base section. However, this rotation is only possible in the rotational direction facilitating normal, articulated thumb movement similar to that incurred when closing a fist. If the tip section is rotated in an opposite direction (i.e., a direction towards hyperextension of the thumb), then the tip section will contact a stop formed by the notch in the base section. This stop prevents further rotation of the tip section in that direction.

In accordance with another aspect, the present invention provides a hockey glove system comprising upper and lower gloves that are asymmetric from each other. The upper glove's main roles are to protect the player's hand, help the player grasp the stick near its butt end, and provide stability and a pivot point for shots and slashing motions, etc. The lower glove's main roles are to protect the player's hand while grasping the hockey stick along the shaft but closer to the blade, and provide power and control when the player shoots, slashes, passes, catches or otherwise advances the puck.

To facilitate improved control and minimize padding interference with a player's grip or hand movement, the lower glove is arranged so that the last two fingers, i.e., the pinky and ring fingers of the hockey player's hand, are kept together in one finger gusset of the control glove. Thus, the control glove is considered a three-fingered glove, the pinky and ring fingers being disposed together in one glove finger.

The upper glove, on the other hand, facilitates use of all of the player's fingers to maximize the player's grasp over that portion of the stick, and thus maximize stability of grip. Accordingly, the grasp glove has four fingers.

Because the upper and lower hands tend to grip the hockey stick in a somewhat different manner, the palm reinforcement strips of each glove also differ according to function. In the upper glove, the palm strip extends generally diagonally across the palm from the index finger to the outside base of the palm. In the lower glove, the palm reinforcement strip extends generally perpendicularly to the fingers.

The upper and lower gloves preferably have differing padding arrangements. The upper glove, which generally grasps the hockey stick with the palm facing downward and requires forward movement of the wrist to facilitate its role as a pivot point, is heavily padded along the cuff on the outer wrist to protect the hand and wrist, but lightly padded on the palm side of the wrist to facilitate the pivoting motion. The lower glove, which generally grasps the hockey stick with the palm facing upward, is heavily padded along the cuff along the palm side and base of the thumb. Thus, the most vulnerable areas are more heavily padded.

In another aspect, the present invention provides a hockey glove comprising a palm, a protective back extending over the palm, a thumb portion, and a plurality of finger gussets. The back has at least one foam segment adapted to provide padding for a wearer's hand disposed within the glove. The thumb portion has a base communicating with the palm and the back. The finger gussets are adapted to accommodate the wearer's fingers. At least one of the finger gussets is adapted to accommodate more than one finger.

In accordance with yet another aspect, the above hockey glove is combined with a second hockey glove having a separate finger gusset for each of the wearer's fingers.

In accordance with a still further aspect, the present invention provides a hockey glove system comprising an upper and lower glove. Each glove comprises a palm and a protective back extending over the palm. The protective back has at least one foam segment adapted to provide padding for a wearer's hand disposed within the glove. The upper and lower gloves have asymmetrical construction relative to each other. The lower glove includes means for grasping a hockey stick in a manner to emphasize enhancement of stick control. In a still further aspect, the upper glove includes means for grasping a hockey stick in a manner to emphasize enhancement of the upper glove's pivot-point function.

In accordance with yet another aspect of the present invention, a hockey glove is provided having a thumb member. The thumb member is padded and comprises a rigid articulating skeleton. The skeleton comprises at least two sections pivotably joined together. The sections are adapted to be rotatable relative to each other to allow rotation between a closed position and an open position. A stop is provided to prevent rotation in an open direction beyond the open position.

In accordance with a still further aspect of the present invention, a hockey glove is provided having a thumb member. The thumb member is padded and comprises a rigid articulating skeleton. The skeleton comprises at least two sections pivotably joined together. The sections are adapted to be rotatable relative to each other to allow rotation between a closed position and an open position. Locking means is provided for preventing rotation of the sections in an open direction beyond the open position.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

FIG. 1 is a perspective view of a preferred embodiment of a hockey upper glove having features of the present invention, viewed with the palm side down.

FIG. 2 is a perspective view of a preferred embodiment of a hockey upper glove having features of the present invention, viewed with the palm side up.

DETAILED DESCRIPTION OF THE PREFERRED EMBODIMENT

Figure 3:
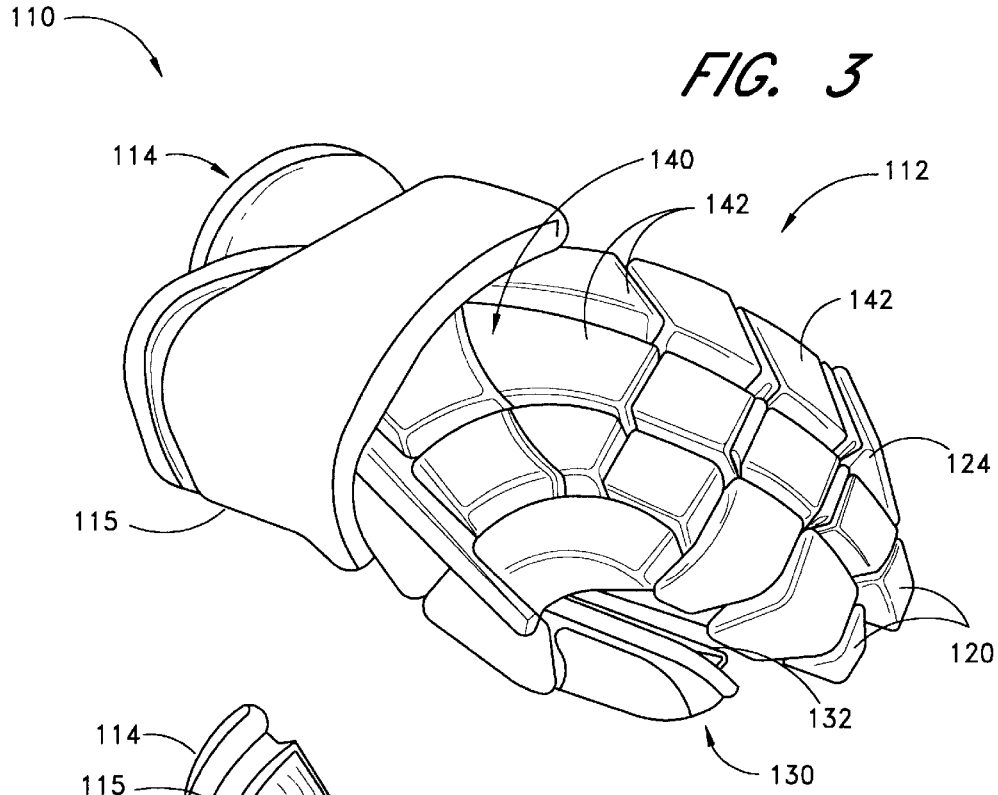
FIG. 3 is a perspective view of a preferred embodiment of a hockey lower glove having features of the present invention, viewed with the palm side down.

With first reference to FIGS. 1 and 2, a hockey upper glove 10 having features in accordance with the present invention is shown. The glove 10 generally comprises a body 12 and a cuff 14. The body 12 has a palm portion 16, fingers 20, a thumb 30, and a back 40. Finger gussets 22 are formed in the fingers 20 for receiving the wearer's fingers therein.

The upper glove 10 is adapted to be worn on a wearer's upper hand which grasps the hockey stick shaft near the stick's butt end. The upper hand's main purposes are to maintain a firm grasp on the stick and to act as a pivot point during shots. When grasping the stick, the upper hand is typically oriented so that the palm is facing generally downward.

The palm portion 16 of the body 12 extends to cover the fronts of the thumb and fingers of the wearer's hand. The palm 16 is preferably formed of split leather or synthetic leather selected for durability and comfort. Preferably, reinforcing gripping sections 18 of material, such as textured synthetic leather, are provided on the palm to improve gripping ability and to provide reinforcement.

A reinforcing strip 17 of material is preferably provided and extends generally diagonally across the palm from about the index finger to the heel of the palm 16 on the pinky finger side of the glove. The orientation and positioning of the reinforcing member 17 is customized for the typical positioning of the wearer's upper hand on the hockey stick. During play, the upper hand typically grasps the stick at an angle. The reinforcing member 17 is preferably oriented to run generally parallel to the stick during this angular grasping. This orientation aids grip and reduces fatigue by reducing the glove's resistance to grasping the stick at such an angle.

The thumb member 30 of the upper glove 10 has a loop 32 formed at the palmfacing side. The loop 32 creates a pocket for alternative placement of the wearer's thumb.

Figure 14:
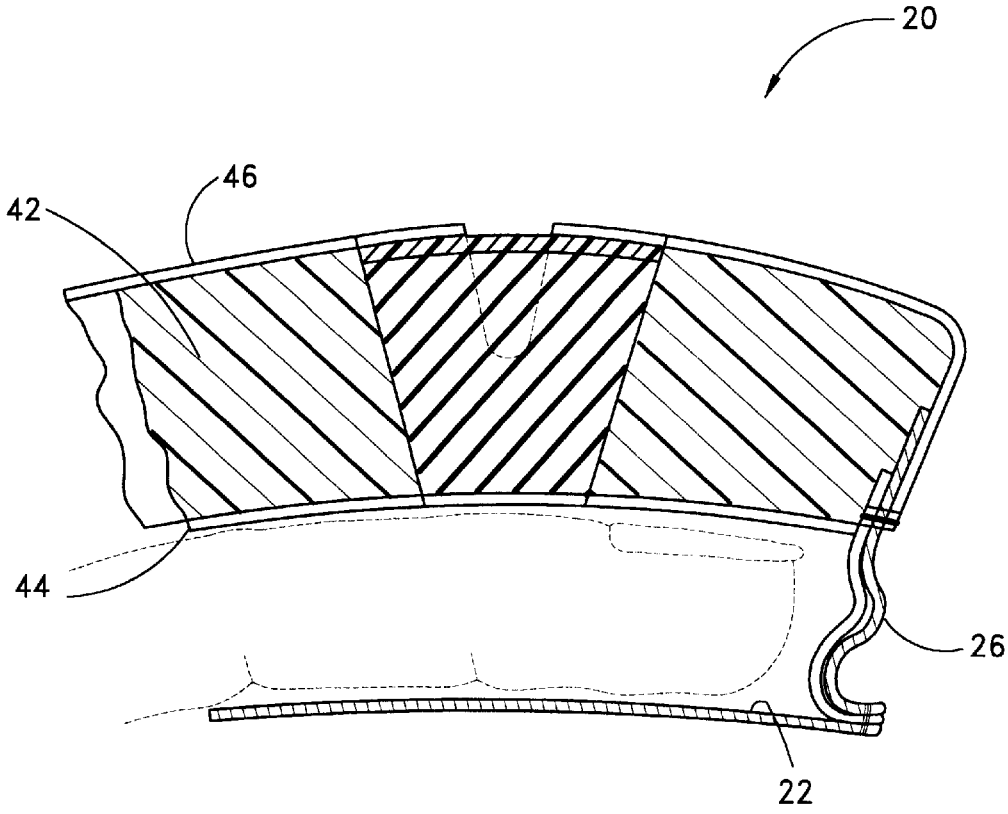
FIG. 14 is a cross sectional view of a finger of the upper glove of FIG. 1 taken along line 14—14.

The finger gussets 22 are preferably formed of leather or another natural or synthetic material selected for softness and durability and may also include holes for ventilation. See, for example, U.S. Pat. No. 5,787,506, titled HOCKEY GLOVE WITH VENTILATION HOLES, which is also owned by Assignee and is incorporated herein by reference in its entirety. FIG. 14 presents a cross sectional view of one of the fingers 20 of the upper glove 10 of FIG. 1. As shown, tabs 26 of split leather are preferably provided over the tips of the finger gussets 22 for greater abrasion resistance, improved gripping ability, and extended wear of the glove 10.

Continuing with reference also to FIG. 14, the back 40 of the glove 10, including the backs of the fingers 20, includes foam segments 42 formed of relatively thick foam sandwiched between an inner liner 44 and an outer cover 46. These segments 42 are preferably formed by waffle-type foam material processed in any known manner. The inner liner 44 typically comprises about ⅛ inch foam covered on both sides by nylon. The foam segments 42 are preferably between about ¼ to one inch thick for providing adequate protection of the hand. Preferably, the outer cover 46 is leather, or a suitable synthetic material such as woven nylon cordura.

The foam segments 42 of the back 40 are formed and grouped to substantially conform to the shape of the back of the hand and fingers of a wearer. The segments 42 on the fingers 20 are preferably formed to curve slightly to imitate a relaxed position of the wearer's hand.

A padded cuff 14 of the upper glove 10 has back, side, and palm portions 14*a*, 14*b*, 14*c*. The back and side portions 14*a*, 14*b* are wider than the palm portion 14*c*. Thus, bending of the wearer's wrist forwardly, at the palm portion 14*c* of the cuff, is less restricted than bending of the wearer's wrist backwardly.

A padded cuff roll 15 is disposed about the cuff 14. The cuff roll 15 is wider. along the back 40 of the glove 10 than on the palm side. Preferably, the cuff roll 15 along the back 40 of the glove 10 has a rigid insert disposed therein, such as a polyethylene plate or another suitable material.

The above-described padding arrangement focuses padding on areas of the upper hand most likely to be exposed to impacts during hockey play. However, forming the cuff smaller on the palm side facilitates the forward wrist pivoting action required by the wearer's upper hand during play. It is to be understood that padding may be added to this upper glove 10 in other areas made vulnerable by its position when gripping a hockey stick. For example, extra padding may be desirably added to the side portion of the pinky finger of the glove 10.

Figure 4:
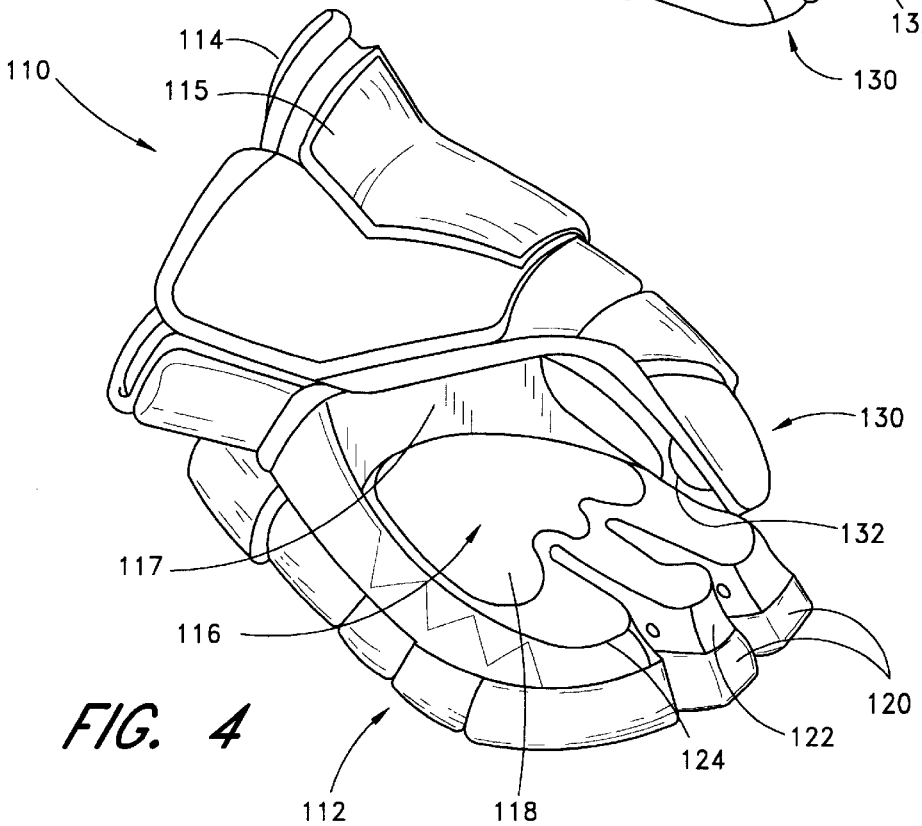
FIG. 4 is a perspective view of a preferred embodiment of a hockey lower glove having features of the present invention, viewed with the palm side up.

With reference next to FIGS. 3 and 4, a hockey lower glove 110 is shown generally comprising a body 112 and a cuff 114. The body 112 has a palm portion 116, fingers 120, a thumb 130, and a back 140. Finger gussets 122 are formed in the fingers 120 for receiving the wearer's fingers therein. The lower glove 110 is adapted to be worn on a wearer's lower hand, which is positioned on the hockey stick shaft between the stick's butt end and the blade. The lower hand's main purpose is to provide aim, control and power when advancing or controlling the hockey puck. When grasping the stick, the lower hand is oriented with the palm generally facing up.

The lower glove 110 shares similar structure with the upper glove 10 in many respects. For example, the palm portion 116, the thumb member 130, the foam segments 42 and their associated arrangements are similar to the corresponding members described with reference to the upper glove 10 and have thus been similarly numbered in the figures. However, the lower glove 110 has some key differences. For instance, a double-fingered gusset 124 is preferably formed on the lower glove 110 and is adapted to receive both the wearer's pinky and ring fingers therein. Accordingly, the lower glove 110 has only three fingers 120, wherein the upper glove 10 has four fingers 20.

The double-finger gusset 124 has been found to decrease the glove's interference with the wearer's stick control. Additionally, this decreased interference has also been found to enable players to focus more power into shooting the puck. Thus, the double-fingered gusset 124 can increase the wearer's control and shooting power.

A reinforcing section 117 of material is preferably provided and extends across the palm 116 generally perpendicularly to the fingers 120, though slightly diagonally. As with the upper glove 10 discussed above, the orientation of the reinforcing section 117 is adapted to follow the grip of the lower hand on the stick. The lower hand typically grasps the hockey stick with the hand generally perpendicular, but slightly diagonal, to the stick. The reinforcing section 117 is oriented so that it will be generally parallel to the stick shaft, thus providing a better grip by reducing grip resistance and increasing grip surface area in contact with the stick.

The cuff 114 is adapted to encircle the wearer's wrist. A padded cuff roll 115 is disposed about the cuff 114. The cuff roll 115 is preferably wider along the base of the thumb member 130 and palm 116 of the glove 110 than on the back side 140. Preferably, the cuff roll 115 along the base of the thumb 130 and palm 116 has a rigid insert disposed therein, such as a polyethylene plate or other suitable material.

It is to be understood that padding may be added to this lower glove 110 in other areas made vulnerable by its position when gripping a hockey stick. For example, extra padding may be desirably added to the side portion of the index finger of the glove. Such padding should consider the lower glove's purpose of providing necessary protection and optimal functionality when oriented in a generally palm-up position.

Figure 5:
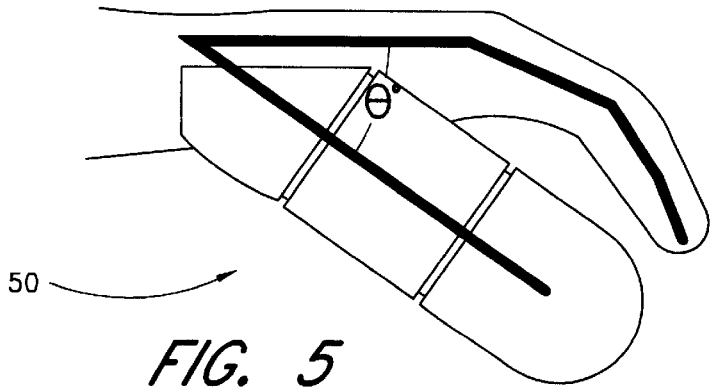
FIG. 5 is a schematic perspective view of a preferred embodiment of an articulated thumb skeleton disposed about a wearer's thumb.

The thumb member 30, 130 of both gloves 10, 110 preferably comprises a substantially rigid articulated skeleton 50. With next reference to FIGS. 5–11, a preferred embodiment of an articulated skeleton 50 having features of the present invention is shown. As shown in FIG. 5, the articulated skeleton 50 is arranged within the glove and adapted to fit over the wearer's entire thumb to protect the thumb from impacts to the thumb area 30, 130 of the glove 10, 110. In order to follow the natural anatomy of the user's hand, the thumb skeleton. 50 is preferably oriented at an angle θ relative to the wearer's palm of about 30–40° and more preferably about 35°.

Figure 6:
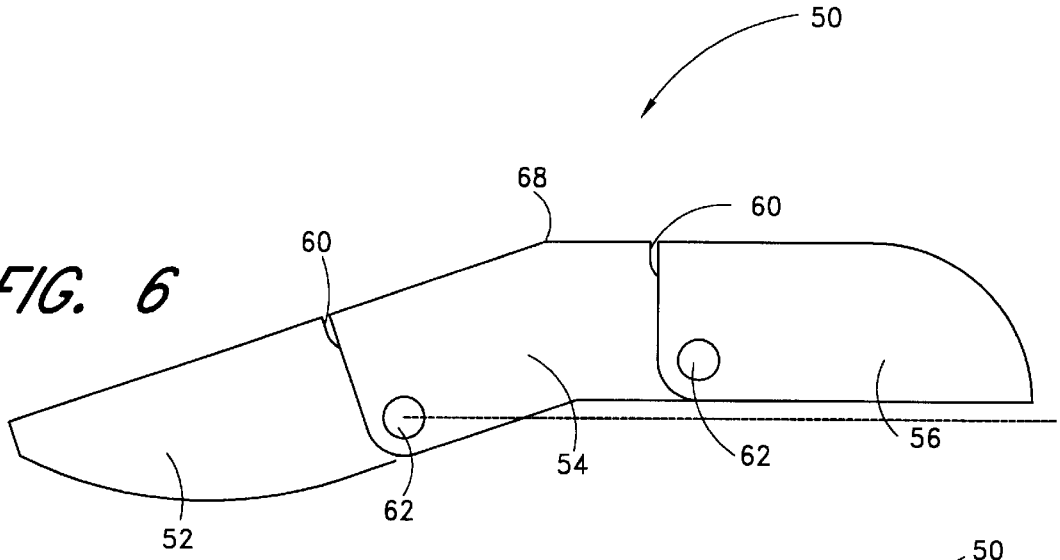
FIG. 6 is a schematic side view of the thumb skeleton of FIG. 5 in an open position.
Figure 7:
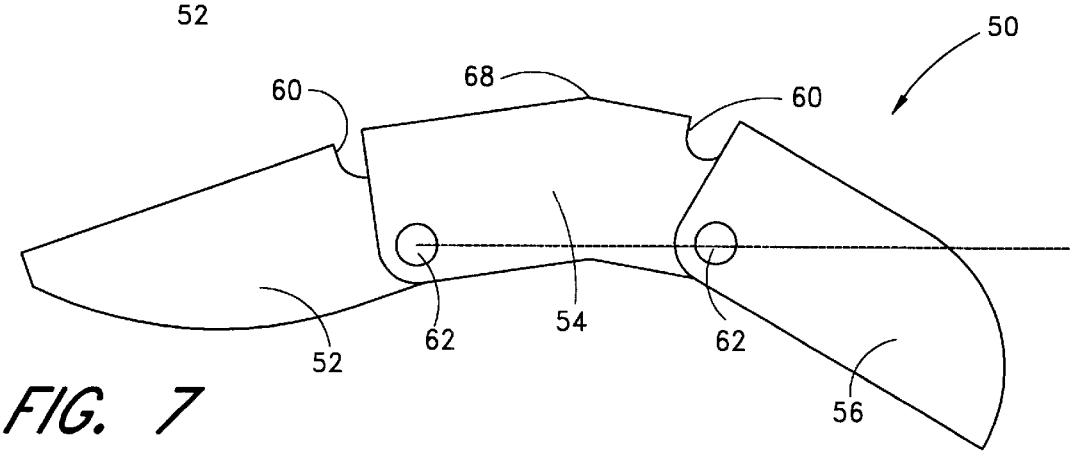
FIG. 7 is a schematic side view of the thumb skeleton of FIG. 5 in a closed position.
Figure 9:
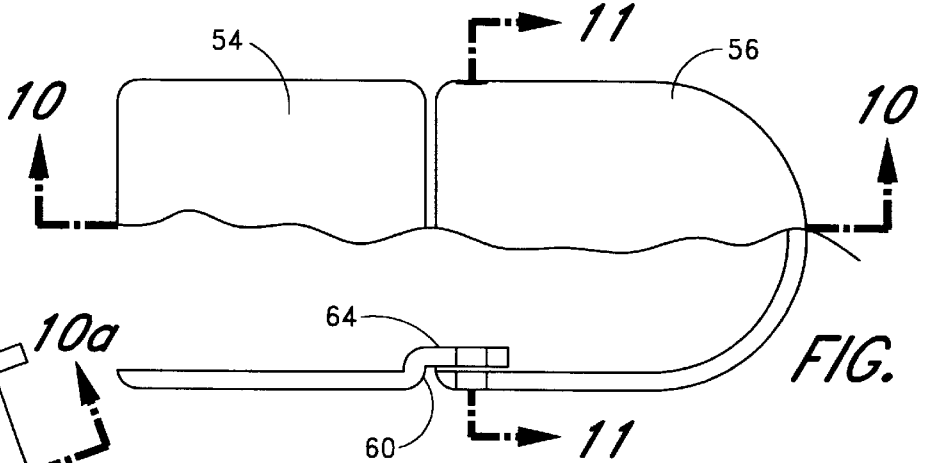
FIG. 9 is a top view of the middle and tip sections of the skeleton of FIG. 5 shown joined and with their top surfaces partially cut away.
Figure 8:
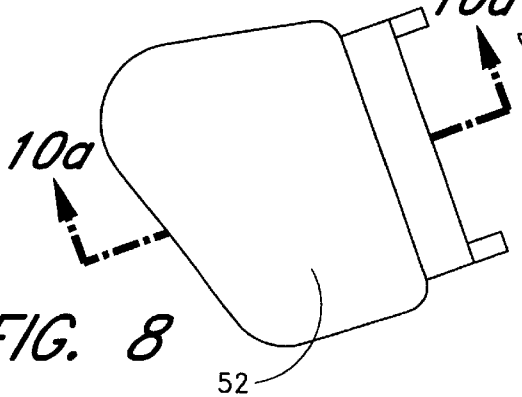
FIG. 8 is a schematic top view of a base section of the thumb skeleton of FIG. 5.
Figure 10:
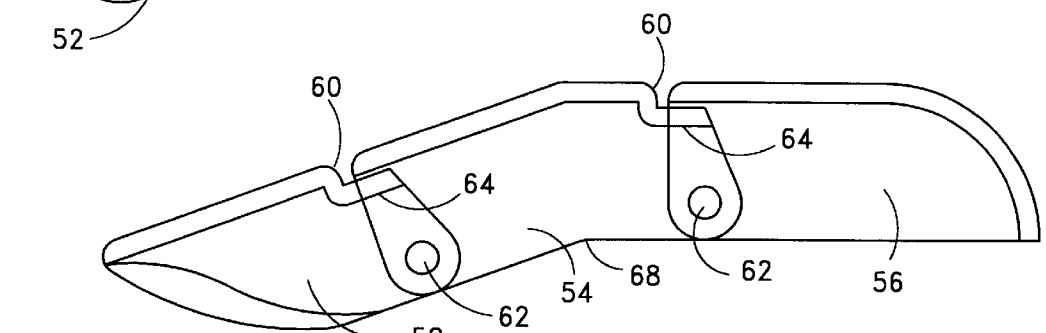
FIG. 10 is a cross sectional view of the sections of FIG. 9 taken along line 10—10 and the base section of FIG. 8 taken along line 10*a*—10*a*, with the sections assembled.

As shown in FIGS. 6–7, the articulated thumb skeleton 50 preferably comprises a base section 52, a middle section 54, and a tip section 56 joined to each other at pivot points 62. The base and middle sections 52, 54 each have a notch 60 formed therein and, as depicted in FIGS. 8–10, an extension 64 extends beyond the notch 60. The pivoting connection between the tip section 56 and middle section 54 is preferably similar to the pivotal connection between the middle section 54 and base section 52. Thus, the preferred pivotal connection between the tip section 56 and middle section 54 will be described below as typical of such a connection.

Figure 11:
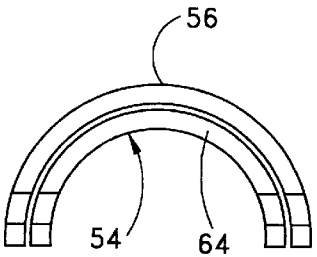
FIG. 11 is a cross sectional view of the adjoining middle and tip sections of FIG. 9 taken along line 11—11.

With specific reference to FIGS. 9–11, the extension portion 64 of the middle section 54 is overlapped by the adjoining tip section 56. The two sections are joined at the pivot point 62 in a manner allowing the sections 56, 54 to rotate relative to one another. Such a connection may be constructed using pins, rods or any other manner known in the art. FIG. 11 shows a cross section of the tip segment 56 overlapping the extension 64 of the middle section 54 and further demonstrates that the articulated skeleton 50 preferably has an arcuate cross section, allowing the skeleton 50 to more closelyfit at least partially around the wearer's thumb to provide protection while maintaining a low profile.

When the sections 52, 54, 56 of the articulated skeleton 50 are pivotably joined together, the skeleton 50 may articulate and move from the open position shown in FIG. 6 to the closed position shown in FIG. 7. The closed position roughly follows the position of a thumb while grasping a hockey stick. Thus, the sections of the articulated skeleton move with the wearer's thumb as it grasps the stick. As a result, the wearer's grasp is improved and fatigue during grasping is minimized.

Pivoting of the thumb sections in the opposite direction beyond the open position is undesirable because of the danger of thumb hyperextension. To prevent possible hyperextension of the thumb, rotation is stopped when the tip section 56 comes into contact with the notch 60 of the middle section 54. Similarly, rotation is stopped when the middle section 54 comes into contact with the notch 60 of the base section 52. Thus, pivoting in a closed direction is enabled, but pivoting in the opposite, open direction beyond the open position is prevented.

It is to be understood that other methods and apparatus known in the art for constructing the skeleton may be employed to achieve the locking mechanism. For example, a post, wall, or ridge near the front end of each section may prevent rotation beyond the desired open position. Also, even if a notch is not employed, the adjacent sections may still be arranged to overlap each other and can be adapted so that contact between the overlapping sections prevents undesired rotation.

The middle section 54 preferably, has a bend 68 formed therein. This bend 68 helps the skeleton 50 to more closely approximate the normal position of the wearer's thumb within the glove in a relaxed position. However, this bend 68 is not required and need not be employed in other embodiments, such as those shown in FIGS. 12 and 13.

Figure 12:
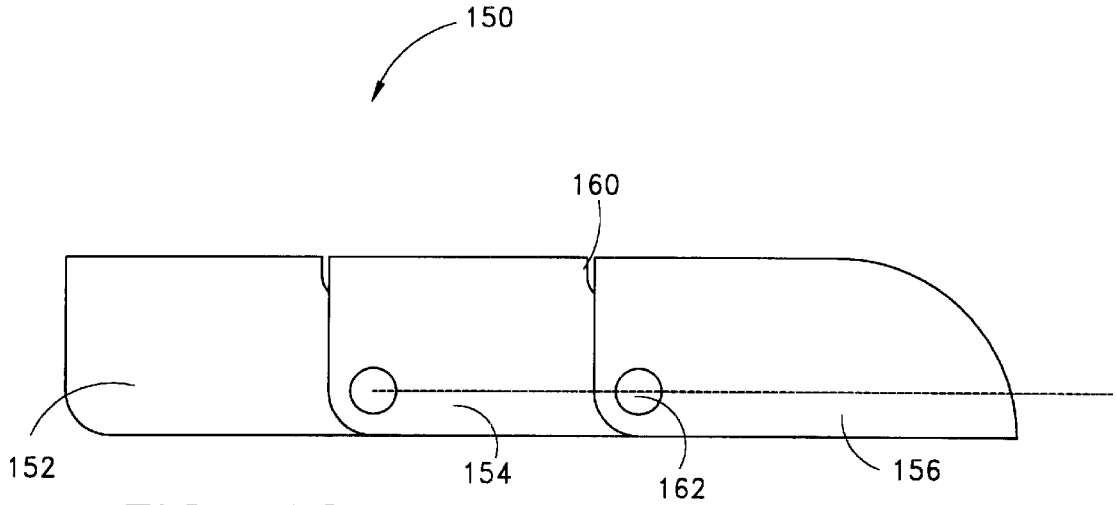
FIG. 12 is a schematic side view of another embodiment of an articulated thumb skeleton having features of the present invention and shown in an open position.
Figure 13:
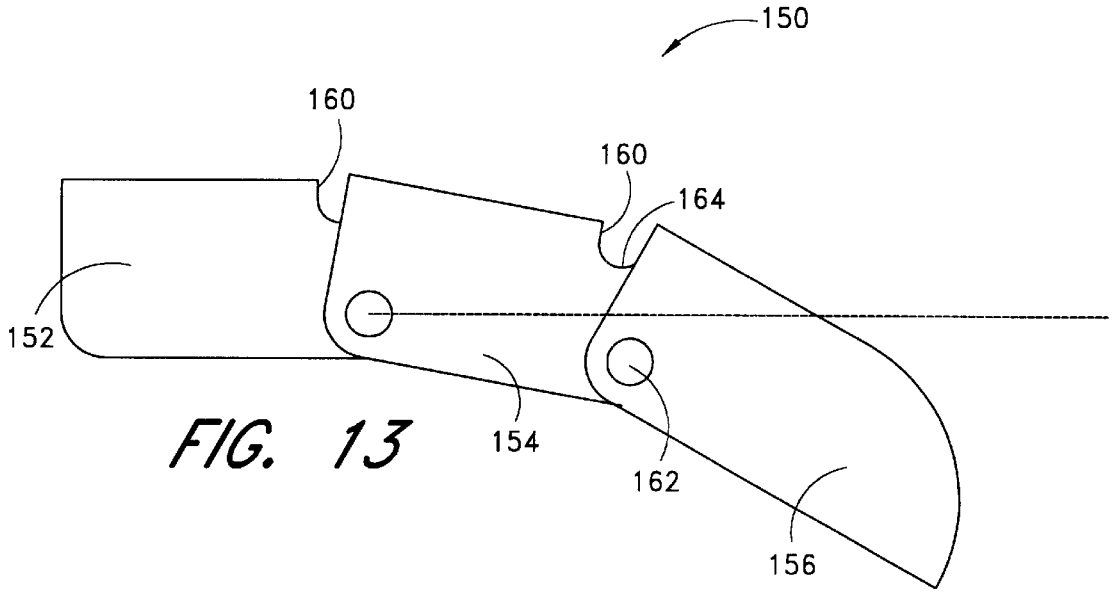
FIG. 13 is a schematic side view of the thumb skeleton of FIG. 12, shown in a closed position.

FIGS. 12 and 13 illustrate another preferred embodiment of an articulated skeleton 150 having three adjoining sections including a base section 152, a middle section 154, and a tip section 156. The base and middle sections 152, 154 have notches 160 formed therein and extensions 164 extending beyond these notches 160. The sections 152, 154, 156 are rotatably connected to each other at pivot points 162. The skeleton 150 preferably articulates in a manner similar to the skeleton 50 embodiment discussed above.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A hockey glove system comprising an upper and a lower glove, each glove comprising a palm and a protective back extending over said palm, the protective back having at least one foam segment adapted to provide padding for a wearer's hand disposed within the glove, and the upper and lower gloves having asymmetrical construction relative to each other, the lower glove including means for grasping a hockey stick in a manner to emphasize enhancement of stick control.

2. A hockey glove system as in claim 1, wherein the upper glove is adapted to allow the hockey stick to pivot about the upper glove when the upper glove is grasping the stick, and the upper glove includes means for grasping the hockey stick in a manner to emphasize enhancement of the upper glove's ability to function as a pivot for the stick.

3. A pair of hockey gloves comprising a first glove and a second glove, each of the gloves comprising a palm, a protective back extending over said palm and having at least one foam segment adapted to provide padding for a wearer's hand disposed within the glove, a thumb portion having a base communicating with the palm and the back, and a plurality of finger gussets adapted to accommodate the wearer's fingers, wherein at least one finger gusset of the first hockey glove is adapted to accommodate more than one finger.

4. The hockey glove pair of claim 3, wherein the second glove includes a separate finger gusset for each of the wearer's fingers.

5. The hockey glove pair of claim 3, wherein the second glove includes a padded cuff portion communicating with the palm and the back, the cuff portion having more padding about the back than about the palm.

6. The hockey glove pair of claim 5, wherein the cuff portion includes a cuff roll, and the cuff roll has a width about the back of the glove greater than a width about the thumb of the glove.

7. The hockey glove pair of claim 3, wherein the second glove includes a grasp strip attached to the palm and extending generally diametrically across the palm.

8. The hockey glove pair of claim 7, wherein the second glove includes an index gusset adapted to accommodate the wearer's index finger and a pinky gusset adapted to accommodate a wearer's pinky finger, and the palm includes a heel, and the grasp strip extends across the palm from the index gusset to the heel generally opposite the pinky gusset.

9. The hockey glove pair of claim 3, wherein the thumb includes an articulating skeleton, the skeleton comprising a plurality of sections pivotally joined to each other.

10. The hockey glove pair of claim 9, wherein the articulating skeleton is adapted to allow rotation of the sections relative to one another between an open position and a closed position.

11. The hockey glove pair of claim 10, wherein the skeleton includes stops adapted to prevent rotation of the sections relative to one another in an opening direction beyond the open position.

12. The hockey glove pair of claim 3, wherein at least one finger gusset of the first glove is adapted to accommodate the wearer's ring and pinky fingers.

13. The hockey glove pair of claim 3, wherein the finger gussets are movable independent of one another.

14. The hockey glove pair of claim 5, wherein the first glove has a padded cuff portion communicating with the palm, the back, and the thumb base, the cuff portion having more padding about the thumb base and palm than about the back.

15. The hockey glove pair of claim 14, wherein the first glove cuff portion includes a cuff roll, and the cuff roll has a width about the thumb and palm greater than a width about the back of the glove.

16. The hockey glove pair of claim 3, wherein the palm of the first glove includes a strip extending across the palm in a direction slightly offset from a direction perpendicular to the finger gussets.

17. The hockey glove pair of claim 3, wherein the thumb portions are movable independent of the finger gussets.

18. A hockey glove system comprising an upper glove and a lower glove, each glove comprising a palm, a protective back extending over the palm, the protective back having at least one foam segment adapted to provide padding for a wearer's hand disposed within the glove, a plurality of finger gussets adapted to accommodate the wearer's fingers, and a thumb portion having a base communicating with the palm and the back, the thumb portion being movable independent of the finger gussets so that movement of the thumb is unconstrained by the finger gussets, wherein the upper and lower gloves have asymmetrical construction relative to each other.

19. The hockey glove system of claim 18, wherein at least one finger gusset of the lower glove is adapted to accommodate more than one finger.

20. The hockey glove system of claim 19, wherein at least one finger gusset of the lower glove is adapted to accommodate the wearer's ring and pinky fingers.

21. The hockey glove system of claim 19, wherein the upper glove includes a separate finger gusset for each of the wearer's fingers.

22. The hockey glove system of claim 19, wherein the finger gussets are movable independent of one another.

23. The hockey glove system of claim 18, wherein each of the gloves has a padded cuff portion communicating with the palm, the back, and the thumb base, and the lower glove cuff portion has more padding about the thumb base and palm than about the back, and the upper glove cuff portion has more padding about the back than about the palm.

24. The hockey glove system of claim 23, wherein the thumb of each glove includes an articulating skeleton, the skeleton comprising a plurality of sections pivotally joined to each other.

25. A pair of protective sports gloves comprising a first glove and a second glove, each of the gloves comprising a palm, a protective back extending over said palm and having at least one foam segment adapted to provide padding for a wearer's hand disposed within the glove, a thumb portion having a base communicating with the palm and the back, and a plurality of finger gussets adapted to accommodate the wearer's fingers, wherein the first and second gloves are configured to enable a wearer to grasp a sport stick, and wherein more padding is provided at or adjacent the back of the first glove than is provided at or adjacent the back of the second glove.

26. The pair of protective sports gloves of claim 25, wherein more padding is provided at or adjacent the palm of the second glove than is provided at or adjacent the palm of the first glove.

27. The pair of protective sports gloves of claim 25, wherein each of the gloves comprises a padded cuff portion adjacent at least one of the back, and thumb and palm, and wherein the configuration of the padded cuff of the first glove is not symmetrical to the configuration of the padded cuff of the second glove.

28. The pair of protective sports gloves of claim 27, wherein a width of the cuff adjacent the back of the first glove is greater than a width of the cuff adjacent the back of the second glove.

29. The pair of protective sports gloves of claim 28, wherein the first glove's cuff has a greater width adjacent the back than adjacent the palm, and the glove's cuff has a greater width adjacent the palm than adjacent the back.

30. The pair of protective sports gloves of claim 28, wherein the cuff adjacent the back of the first glove comprises a rigid insert.

31. The pair of protective sport gloves of claim 30, wherein the cuff adjacent the palm of the second glove comprises a rigid insert.

32. The pair of protective sports gloves of claim 31, wherein a width of the cuff adjacent the palm of the second glove is greater than a width of the cuff adjacent the palm of the first glove.

33. The pair of protective sports gloves of claim 25, wherein each finger gusset of the first glove is configured to accommodate one of the wearer's fingers, and at least one finger gusset of the second glove is adapted to accommodate more than one finger.

* * * * *